United States Patent [19]

Dellian

[11] 4,032,291

[45] June 28, 1977

[54] PHENYL PHTHALATE CARRIERS IN DYEING AND PRINTING SYNTHETIC FIBERS

[75] Inventor: Kurt Adolf Dellian, Greensboro, N.C.

[73] Assignee: Ciba-Geigy Corporation, Ardsley, N.Y.

[22] Filed: Jan. 12, 1976

[21] Appl. No.: 648,333

[52] U.S. Cl. ..... 8/34; 8/39 B; 8/39 C; 8/92; 8/130.1; 8/173; 8/175; 8/178 A; 8/179

[51] Int. Cl.[2] ..... D06P 5/04; C09B 9/00

[58] Field of Search ..... 8/34, 173, 92, 130.1

[56] References Cited

UNITED STATES PATENTS

| | | | |
|---|---|---|---|
| 3,148,934 | 9/1964 | Brookens et al. | 8/4 |
| 3,510,891 | 5/1970 | Ludngo | 8/173 |
| 3,700,405 | 10/1972 | Petite | 8/173 |
| 3,917,447 | 11/1975 | Lazar et al. | 8/92 |
| 3,932,128 | 1/1976 | Beaulieu | 8/173 |

OTHER PUBLICATIONS

B537,058, Mar. 1976, Dellian et al., 8/173.

*Primary Examiner*—Joseph L. Schofer
*Assistant Examiner*—A. L. Clingman
*Attorney, Agent, or Firm*—Karl F. Jorda; Edward McC. Roberts; Prabodh I. Almaula

[57] ABSTRACT

Synthetic fibers are dyed or printed with a disperse or vat dyestuff in the presence of a carrier of the formula

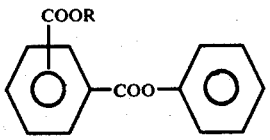

wherein R represents alkyl of 1 to 12 carbon atoms, benzyl or phenyl.

18 Claims, No Drawings

PHENYL PHTHALATE CARRIERS IN DYEING AND PRINTING SYNTHETIC FIBERS

The present invention is directed to a process for dyeing and/or printing synthetic fibers, especially synthetic textile fibers, in the presence of a carrier having low odor, low toxicity and which is biodegradable.

The present invention is directed to an improvement in the method of dyeing fibrous materials which do not readily absorb water. The hydrophobic nature of the fibers makes the dyeing of this material difficult and poses practical problems.

When attempting to dye a hydrophobic fibrous material with an aqueous dispersion of a disperse or vat dye without the presence of a carrier, almost no color is ordinarily absorbed by the hydrophobic material, even at the boiling point of water.

In order to assist penetration of the dye into the fibrous material during the dyeing process, carriers, which provide for easier penetration of the dyestuff into the material, are utilized.

The use of carriers in dyeing and printing techniques on hydrophobic fibrous material allows satisfactory results with reference to dye penetration.

Conventional carriers included chlorinated hydrocarbons, such as chlorinated benzene, biphenyl and derivatives of benzene or phenol, such as ortho- or para-phenylphenol.

While the performance of the prior art carriers has been generally satisfactory with regard to assisting dye penetration, nevertheless many conventional carriers possess numerous undesirable ecological properties. Such undesired properties included unacceptable toxicity, non-biodegradableness and undue odoriferousness.

Accordingly, it is an object of the present invention to provide a process for dyeing hydrophobic fibrous materials in the presence of an ecologically acceptable dye carrier having high carrier efficiency of temperatures over 100°C, e.g. at temperatures from about 105° to about 135°C.

The above and other objects are met in a process for coloring synthetic hydrophobic fibrous materials such as textile fibrics and the like, with a disperse or vat dyestuff in a carrier of the following general formula

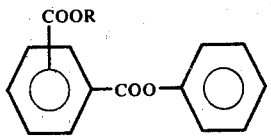

(I)

wherein R is alkyl of 1 to 12 carbon atoms, benzyl or phenyl.

In a preferred embodiment of the invention, R is alkyl of 1–6 carbon atoms. In a most preferred embodiment, R is methyl.

The —COOR group may be in the ortho, meta or para position, relative to the phenoxycarbonyl group. Preferably, the —COOR group is in the ortho position.

The compounds, per se, are known and are easily prepared by conventional techniques.

For example, the mono-phenyl phthalic acid ester may be esterified with the appropriate alcohol to produce compounds of formula (I). Alternatively, the diphenyl phthalate may be transformed to the mixed esters through trans-esterification with the appropriate alcohol.

Of course, mixtures of compounds within the scope of formula (I) are also contemplated for use in the present invention.

The carriers of the present invention have been found to be of low odor, low toxicity and are substantially biodegradable.

The processes and compositions of the present invention are preferably directed to the dyeing and printing of shaped structures, that is textile fibers made of hydrophobic polymers. As employed herein, fibrous material includes fibers, yarns, threads, fibric, ribbons, tapes and tabs. A suitable example of a hydrophobic fibrous material is a polyester, such as a high melting polyester containing six membered carbocyclic rings or acid modified carbocyclic rings receptive for cationic dyes. Illustrative of the polyesters that may be employed are polyethylene terephthalate. However, the general technique of the present invention employing the novel carrier disclosed herein is also applicable to other hydrophobic synthetic materials containing a variety of ester groups in the molecule and being difficult to dye, such as cellulose triacetate, and the like. Also suitable for the processes and compositions of the present invention are fibrous materials of aromatic polyamides such as those available under the trademarks KEVLAR and NOMEX, as well as polyamides of 4,4′ -bis aminocyclohexylmethane and aliphatic diacids, such as the polyamide available under the trademark QIANA. Blennds and mixes of the aforementioned fibrous materials may also be dyed employing the present carriers.

In general, the carriers are dissolved, dispersed or emulsified in a dyebath according to conventional procedures.

It is preferred that the carrier be emulsified, since the instant ecologically desirable carriers are water-insoluble. The carrier may be conventionally emulsified by pre-mixing the carrier with the emulsifier and thereafter forming an emulsion in the dyebath. Alternatively, the carrier can be dissolved in a solvent such as an alcohol, and then added to the dyebath which contains a suitable emulsifier. Examples of particularly useful emulsifiers include ethoxylated sulfonates of alkylarylphenols or sulfates of higher fatty acids. Other useful emulsifiers include polyglycol ethers derived from condensation of ethylene oxide and higher fatty alcohols, alkylphenols or fatty amines. Preferred emulsifiers include salts or sulfonated detergents as sulfonated benzimidazoles substituted by higher alkyl radicals at the second carbon atom; salts of monocarboxylic acid esters of 4-sulfophthalic acid with higher fatty alcohols; salts of fatty alcohol sulfonates, alkylaryl sulfonic acids or condensation products of higher fatty acids with aliphatic hydroxysulfonic or aminosulfonic acids.

Although the amount of emulsifier which may be employed may be widely varied, it is generally preferred for practicality and efficiency to employ from about 3 to 20% of emulsifier based on the weight of carrier. Over 20% emulsifier by weight of carrier tends to be unduly excessive, while amounts under about 3% tend to be insufficient to bring the insoluble carriers into a stable emulsion.

The concentration of the carrier in the dyebath may vary between relatively broad ranges. It is preferable that from about 2 to 15% carrier by weight of textile goods (fabric) is employed.

Enhanced dyeing is obtained and consequently it is particularly preferred that from about 2 to 6% by weight of carrier is employed based on the weight of the textile goods. Of course, the particular optimum concentration of carrier will depend in part on the type of disperse or vat dye employed, the fiber to be dyed and the technique of application.

In general, the dyeing process may be employed with any of the conventional disperse or vat dyestuffs known to the art. As illustrative of suitable disperse and vat dyes are Color Index — C.I. — Disperse Dyes and C.I. — Vat Dyes.

In printing, it is preferred that from about 4 to 6% by weight of carrier is present. Also, when printing, a conventional thickening agent is used.

Illustrative of such agents are sodium or ammonium salts of polyacrylic acids, alginates, locust bean gum and starch ethers.

Accordingly, one embodiment of the present invention includes a composition comprising the instant inventive carrier and an emulsifier. Preferably, the emulsifier is a non-ionic or anionic emulsifier or mixtures thereof.

As an alternative embodiment, one may utilize an emulsion comprising an emulsifier, preferably an anionic or non-ionic emulsifier and mixtures thereof, the instant inventive carrier, and sufficient water to form a stable emulsion thereof.Preferably, water is present in an amount of about 5-50% by weight of the composition.

In this embodiment, the dyebath emulsion is easily formed by mixing the emulsion with dyestuff and water to form the dyebath.

In addition, one embodiment of the invention includes a printing paste containing the inventive carrier, thickner, emulsifier dyestuff and water.

The following examples illustrate certain preferred embodiments of the invention and are not limitative of the scope. All parts and percentages are by weight unless otherwise indicated.

EXAMPLE 1

A self-emulsifying solution was formed of the following composition:

92 parts of methyl-phenyl-phthalate
4 parts of sulfated oxethylated nonylphenol (10 mol ehtylene oxide)
4 parts of sulfonated oleic acid amylester.

An aqueous dyebath was prepared containing 4% (based on the weight of the fabric) of the emulsion and 2% (based on the weight of the fabric) of a dyestuff of the following formula

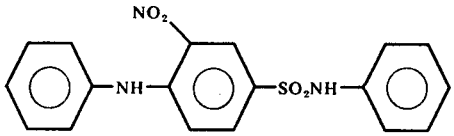

Disp. Yellow 42 in a liquor ratio 20:1. A polyester double knit fabric was introduced and the dyebath heated 45 minutes at 125° C under sealed and pressurized conditions. Thereafter the fabric was rinsed and soaped. A brilliant yellow shade was obtained with very good fastness properties. The dyebath was completely exhausted.

EXAMPLE 2

A print paste was prepared containing 0.3% of the sodium salt of polyacrylic acid, 3% of a dyestuff of the following constitution

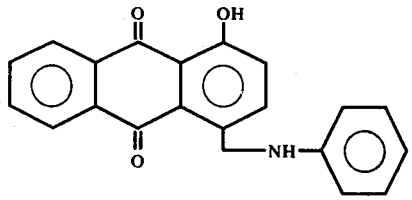

Disp. Blue 64 and 5% of the self-emulsifying composition of Example 1. A polyester fabric was screen printed and submitted to a 30 min. steaming at 20 psi pressure. After rinsing and soaping the polyester knit was printed in a deep blue shade with good overall fastness properties.

EXAMPLE 3

The same as Example 1 but instead of methyl-phenylphthalate ethyl-phenyl-isophthalate was used. Similar results are obtained.

EXAMPLE 4

The same as Example 2 but propyl-phenyl-terephthalate was used and 2.5% of a dyestuff of the following formula:

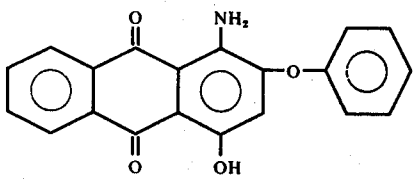

A deep red shade was obtained.

What is claimed is:

1. In a process for coloring a hydrophobic fibrous material with a disperse or vat dyestuff with the aid of a carrier, the improvement wherein the carrier comprises a compound of the formula

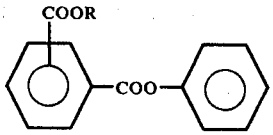

wherein R is alkyl of 1 to 12 carbon atoms, benzyl or phenyl or mixtures thereof.

2. A process according to claim 1, wherein R is alkyl of 1–6 carbon atoms.

3. A process according to claim 2, wherein R is methyl.

4. A process according to claim 1, wherein the -COOR group is ortho to the phenoxycarbonyl group.

5. A process according to claim 4, wherein R is alkyl of 1-6 carbon atoms.

6. A process according to claim 5, wherein R is methyl.

7. A process according to claim 1, wherein the hydrophobic textile material is polyethylene terephthalate.

8. A process according to claim 1, wherein the hydrophobic material is an aromatic polyamide.

9. A process according to claim 1, wherein the hydrophobic material is a polyamide of 4,4'-bis aminocyclohexylmethane and an aliphatic diacid.

10. In a process for coloring an acid modified polyester with a cationic dyestuff in the presence of a carrier, the improvement wherein the carrier comprises a compound of the formula

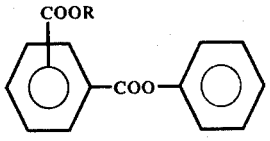

wherein R is alkyl of 1–12 carbon atoms, benzyl or phenyl.

11. A dye carrier composition comprising a mixture of a. a compound of the formula

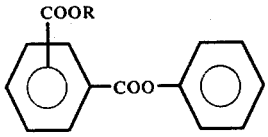

wherein R is alkyl of 1-12 carbon atoms, benzyl or phenyl, or mixtures thereof, and b. an anionic or nonionic emulsifier, or mixtures thereof, wherein about 3 to 20% of emulsifier is present based upon the weight of said compound.

12. A dye carrier composition according to claim 11, wherein R is alkyl of 1–6 carbon atoms.

13. A stable dye carrier emulsion comprising a. a compound of the formula

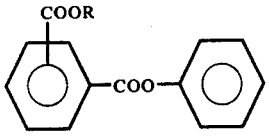

wherein R is alkyl of 1–12 carbon atoms, benzyl, phenyl or mixtures thereof, b. an anionic or nonionic emulsifier or mixtures thereof, wherein about 3 to 20% of emulsifier is present based upon the weight of said compound, and c. water in an amount of about 5 to 50% by weight of said compound.

14. A stable dye carrier emulsion according to claim 13, wherein R is alkyl of 1–6 carbon atoms.

15. In a dyebath comprising an emulsion of disperse or vat dyestuff, emulsifier, water and carrier, the improvement wherein the carrier has the formula

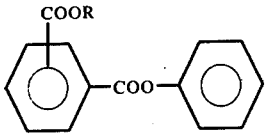

wherein R is alkyl of 1–12 carbon atoms, benzyl or phenyl, or mixtures thereof.

16. A dyebath according to claim 15, wherein R is alkyl of 1–6 carbon atoms.

17. In a printing paste composition comprising an emulsion of disperse or vat dyestuff, emulsifier, water, thickener and carrier, the improvement wherein the carrier has the formula

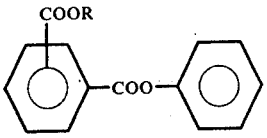

wherein R is alkyl of 1–12 carbon atoms, benzyl or phenyl, or mixtures thereof.

18. A printing paste according to claim 17, wherein R is alkyl of 1–6 carbon atoms.

* * * * *